United States Patent [19]

Whittenberger

[11] 4,012,237

[45] Mar. 15, 1977

[54] ZIRCONIUM MODIFIED NICKEL-COPPER ALLOY

[75] Inventor: John D. Whittenberger, North Olmsted, Ohio

[73] Assignee: The United States of America as represented by the Administrator of the National Aeronautics and Space Administration, Washington, D.C.

[22] Filed: June 5, 1975

[21] Appl. No.: 584,094

[52] U.S. Cl. ..... 148/2; 75/170; 148/12.7 N; 148/20.3; 148/32.5; 148/162

[51] Int. Cl.[2] ..... C22F 1/02

[58] Field of Search ..... 75/170; 148/32, 32.5, 148/12.7 N, 11.5 N, 162, 2, 3, 20.3

[56] References Cited

UNITED STATES PATENTS

| | | | |
|---|---|---|---|
| 2,150,095 | 3/1939 | Kayes | 75/170 |
| 2,283,246 | 5/1942 | Wise et al. | 75/170 |

*Primary Examiner*—R. Dean

*Attorney, Agent, or Firm*—N. T. Musial; G. E. Shook; John R. Manning

[57] ABSTRACT

An improved material for use in a catalytic reactor which reduces nitrogen oxide from internal combustion engines is in the form of a zirconium-modified, precipitation-strengthened nickel-copper alloy. This material has a nominal composition of Ni-30 Cu-0.2 Zr and is characterized by improved high temperature mechanical properties.

5 Claims, No Drawings

ZIRCONIUM MODIFIED NICKEL-COPPER ALLOY

ORIGIN OF THE INVENTION

The invention described herein was made by an employee of the U.S. Government and may be manufactured and used by or for the Government for governmental purposes without the payment of any royalties thereon or therefor.

BACKGROUND OF THE INVENTION

This invention is concerned with improving the elevated temperature strength of Ni-30 Cu alloys without affecting their oxidation characteristics. The invention is particularly directed to improving these alloys for use in catalytic reactors.

Nickel base alloys containing about 30% copper are used at moderate temperatures where good corrosion resistance is required. Alloys known commercially as Monels, a registered trademark of the International Nickel Company, have been satisfactory for such uses. U.S. Pat. No. 3,842,159 to Niebylski et al discusses the application of Monel metal to automotive $NO_x$ emissions control.

Monel alloy 400 has been of particular interest as a catalyst for the reduction of nitrogen oxide. However, this alloy lacks long term durability. This characteristic appears to be related to grain boundary degradation and subsequent loss in strength.

Oxidation behavior of the Monel alloy is important in catalytic applications because the formation of NiO and CuO oxides on the Monel surface play an active role in the reduction of $NO_x$. Thus, any attempt to strengthen the Ni-30 Cu base alloys must not affect the overall surface oxidation characteristic. For example, the use of the high strength aluminum-modified Monel alloy K-500 is undesirable because a continuous unreducible alumina scale could be formed.

Various other alloying materials have been added to nickel-copper alloys to alter the characteristics of the alloys. For example, Fahrenwald U.S. Pat. No. 1,346,190 teaches increasing the hardness and mechanical strength of gun barrels by adding various metals which are soluble in one or the other primary ingredient of a nickel-copper alloy. The strength of nickel-copper cast valves at elevated temperatures has been improved by the addition of zirconium, as set forth in Wise et al. U.S. Pat. No. 2,283,246. However, the prior art teachings have not been directed to improving the high temperature mechanical properties without affecting the oxidation characteristics.

SUMMARY OF THE INVENTION

The problems of the prior art have been solved by an alloy in the form of rolled sheet metal having a nominal composition in weight percent of 30 copper, 0.2 zirconium, and the balance nickel. The addition of the 0.2% zirconium to the base alloy produces after a suitable thermochemical processing a dispersion of precipitates identified as $Ni_5Zr$.

OBJECTS OF THE INVENTION

It is, therefore, an object of the present invention to provide an improved alloy for use in catalytic reactors for the reduction of nitrogen oxide from internal combustion engines.

Another object of the invention is to improve the mechanical strength of Ni-30 Cu alloy at elevated temperatures without affecting the oxidation characteristics.

A further object of the invention is to improve the mechanical strength of a Ni-30 Cu alloy at room temperature.

These and other objects of the invention will be apparent from the specification which follows.

DESCRIPTION OF THE PREFERRED EMBODIMENT

Two alloys of nominal composition, Ni-30 Cu and Ni-30 Cu-0.2 Zr, were vacuum-melted in alumina crucibles and cast into nominal 8×8×1.5 cm sheet-bar molds. The sheet-bar ingots were hot rolled in air in one direction at 1450 K from 1.5 cm to 0.4 cm and warm rolled in air in the same direction at 920 K from 0.4 cm to nominally 0.15 cm. Both the hot rolling and the warm rolling schedules incorporated 10% reduction per pass.

After rolling to gauge, the sheets were solution treated at 1365 K for one-half hour and then cooled to room temperature. The solution treated sheets were then subjected to various thermochemical processing (TMP) schedules involving several amounts of cold work (0 to nominally 10%) followed by annealing between 1025 and 1225 K. More particularly, the TMP involved heat treatments at 1225, 1125, or 1025 K in hydrogen of as-annealed sheets, and annealed plus 10% cold work (rolling in ambient temperature) sheets.

The results of the TMP as determined by hardness testing are given in Table I. These data show that for each TMP schedule the Ni-30 Cu-0.2 Zr alloy is stronger than the Ni-30 Cu alloy, and the 10% cold work plus 1125 K heat treatment yields the best strength improvement.

TABLE I

Hardness of Thermomechanical Processed Ni-30 Cu Base Alloys
(Rockwell F Scale: 0.16 cm Ball, 60 Kg Load)

Starting Condition for Both Alloys, ½-h Anneal at 1365 K

| | | 0 pct Cold Work Prior to Final Heat Treatment | | 10 pct Cold Work (Rolling) Prior to Final Heat Treatment | |
|---|---|---|---|---|---|
| Alloy | Temp of Final Heat Treatment, K | Time of Final Heat Treatment, h | $R_F$ Hardness | Time Final Heat Treatment, h | $R_F$ Hardness |
| Ni-30 Cu | none | — | 75 | — | 101* |
| Ni-30 Cu-Zr | none | — | 77 | — | 102* |
| Ni-30 Cu | 1225 | 1 | 75 | ½ | 76 |
| Ni-30 Cu-Zr | 1225 | 1 | 84 | ½ | 93 |
| Ni-30 Cu | 1125 | 2 | 77 | ½ | 73 |
| Ni-30 Cu-Zr | 1125 | 2 | 89 | ½ | 103 |
| Ni-30 Cu | 1025 | 3 | 77 | ½ | 96 |

TABLE I-continued

Hardness of Thermomechanical Processed Ni-30 Cu Base Alloys (Rockwell F Scale: 0.16 cm Ball, 60 Kg Load)

Starting Condition for Both Alloys, ½-h Anneal at 1365 K

| Alloy | Temp of Final Heat Treatment, K | 0 pct Cold Work Prior to Final Heat Treatment: Time of Final Heat Treatment, h | $R_F$ Hardness | 10 pct Cold Work (Rolling) Prior to Final Heat Treatment: Time Final Heat Treatment, h | $R_F$ Hardness |
|---|---|---|---|---|---|
| Ni-30 Cu-Zr | 1025 | 3 | 88 | ½ | 101 |

*Extrapolated from Rockwell B scale readings.

On the basis of the data of Table I a preferred TMP schedule was determined to be (1) ½ hour anneal at 1365 K in hydrogen, (2) approximately 10% cold work by ambient temperature rolling, and (3) final heat treatment at 1125 K in hydrogen to insure complete precipitation of the second phase in the Ni-30 Cu-0.2 Zr alloy.

Mechanical properties of the preferred TMP'd zirconium modified alloy and similarly processed Ni-30 Cu base alloy are shown in Tables II and III. Tensile-type specimens with a 2.54 cm × 0.63 cm gage section were blanked from the thermomechanically processed alloy sheet. In all cases, the gage length was parallel to the sheet rolling direction. Hardness tests conducted on the blanking scrap revealed that the hardness (Rockwell F scale) of Ni-30 Cu alloy was 85 and Ni-30 Cu-Zr alloy was 95. The reason for the difference in hardness between the initial studies and scale-up could be due in part to possible overaging of the precipitates and regions of recrystallization.

Both alloys were subjected to tensile testing in air at ambient temperature, 800, 1000, 1200, and 1400 K and to constant-load stress-rupture testing in air at 800, 1000, 1100, and 1200 K. In addition, several stress-rupture tests were interrupted prior to failure, and these specimens were tensile tested at ambient temperature in order to obtain a measure of creep damage. All mechanical property testing was conducted in accordance with ASTM Standards. Additional characterization of the alloys included identification of the precipitates in the Ni-30 Cu-Zr alloy and the oxides formed during elevated temperature testing.

The results of the room temperature and elevated temperature tensile tests are given in Table II. These data indicate that the precipitates in the Zr-modified alloy have improved the tensile properties, particularly between 800 and 1200 K where both strength and ductility improvements are apparent. For example, at 1000 K the 0.2 yield strength of the Zr-modified alloy exceeds the ultimate tensile strength of the base Ni-30 Cu alloy.

Stress-rupture tests of the alloys were conducted in air at stress levels nominally designed to produce failure of the Ni-30 Cu alloy in 100 hours. In general, testing was interrupted if the time under stress/temperature conditions exceeded 500 hours or if data from other tests indicated that the life expectancy would greatly exceed 500 hours. Specimens from the interrupted tests were then tensile tested at room temperature to obtain a measure of the amount of creep damage.

The results of the stress-rupture testing are given in Table III. For the various stress/temperature conditions between 800 and 1100 K, the Zr-modified alloy exhibited better properties than the Ni-30 Cu alloy. In this temperature regime, the life of the Ni-30 Cu-Zr alloy exceeded the life of the Ni-30 Cu by at least a factor of four. Metallography of the ruptured specimens revealed that failure of the Ni-30 Cu alloy was probably due to grain boundary cracking at 800 K and a combination of grain boundary cracking and oxidation of the crack surfaces at 1000 and 1100 K. Grain boundary cracks were also seen in the Ni-30 Cu-Zr specimen which failed at 800 K. Failure of Ni-30 Cu-Zr speci-

TABLE II

Tensile Properties of Ni-30 Cu Base Alloys

| Comp | Temp, K | p.2 pct Yield Stress, MN/m² | UTS, MN/m² | Elongation, pct |
|---|---|---|---|---|
| Ni-30 Cu | RT | 200 | 405 | 45 |
| Ni-c0 Cu | RT | 215 | 427 | 43 |
| Ni-30 Cu | RT | 186 | 411 | 45 |
| Ni-30 Cu | RT | 202 | 416 | 45 |
| Ni-30 Cu | RT | 199 | 415 | 47 |
| Ni-30 Cu-Zr | RT | 254 | 482 | 35 |
| Ni-30 Cu-Zr | RT | 234 | 455 | 36 |
| Ni-30 Cu-Zr | RT | 242 | 471 | 37 |
| Ni-30 Cu | 800 | 164 | 261 | 16 |
| Ni-30 Cu | 800 | 170 | 260 | 24 |
| Ni-30 Cu-Zr | 800 | 216 | 390 | 28 |
| Ni-30 Cu-Zr | 800 | 202 | 374 | 32 |
| Ni-30 Cu | 1000 | 108 | 138 | 8 |
| Ni-30 Cu | 1000 | 93 | 136 | 18 |
| Ni-30 Cu-Zr | 1000 | 146 | 178 | 24 |
| Ni-30 Cu-Zr | 1000 | 143 | 182 | 24 |
| Ni-30 Cu | 1200 | 63 | 69 | 20 |
| Ni-30 Cu | 1200 | 63 | 68 | 23 |
| Ni-30 Cu-Zr | 1200 | 77 | 83 | 28 |
| Ni-30 Cu-Zr | 1200 | 78 | 87 | 30 |
| Ni-30 Cu | 1400 | 22 | 22 | 40 |
| Ni-30 Cu-Zr | 1400 | 22 | 22 | 12 |

mens at 1100 K appeared to be the result of grain boundary cracks and oxidation at the cracks; however, the overall damage to the microstructure after testing at 1100 K does not appear to be as severe in the Ni-30 Cu-Zr alloy as in the Ni-30 Cu alloy.

Testing of either alloy at 10 $Mn/m^2$-1200 K resulted in completely oxidized cross sections. Thus the strength improvement of the Zr-modified alloy at 1200 K, as indicated by tensile testing, cannot be realized in a highly oxidizing atmosphere.

Table III

Stress-Rupture Properties of Ni-30 Cu Base Alloys

| Comp | Test Condition Temp, K | Stress, $MN/m^2$ | Life, h | Elongation pct |
|---|---|---|---|---|
| Ni-30 Cu | 800 | 138 | 74.9 | 10 |
| Ni-30 Cu | 800 | 138 | 114.5 | 7 |
| Ni-30 Cu-Zr | 800 | 138 | 504.5* | ~1 |
| Ni-30 Cu-Zr | 800 | 138 | 504.5* | ~1 |
| Ni-30 Cu-Zr | 800 | 159 | 596.7 | 7 |
| Ni-30 Cu | 1000 | 15 | 361.4* | 2 |
| Ni-30 Cu | 1000 | 21 | 170.5* | 2 |
| Ni-30 Cu | 1000 | 21 | 362.2* | 4 |
| Ni-30 Cu | 1000 | 35 | 56.7 | 7 |
| Ni-30 Cu | 1000 | 35 | 153.0 | 17 |
| Ni-30 Cu-Zr | 1000 | 21 | 362.2* | ~1 |
| Ni-30 Cu-Zr | 1000 | 35 | 500.9* | ~1 |
| Ni-30 Cu-Zr | 1000 | 35 | 500.9* | ~1 |
| Ni-30 Cu | 1100 | 21 | 28.1 | 7 |
| Ni-30 Cu | 1100 | 21 | 71.8 | 18 |
| Ni-30 Cu-Zr | 1100 | 21 | 238.2 | 9 |
| Ni-30 Cu-Zr | 1100 | 21 | 173.8 | 6 |
| Ni-30 Cu | 1200 | 10 | 95.5 | Almost |
| Ni-30 Cu | 1200 | 10 | 108.5 | completely |
| Ni-30 Cu-Zr | 1200 | 10 | 107.3 | oxidized |
| Ni-30 Cu-Zr | 1200 | 10 | 108.7 | test sections |

*Specimen removed prior to failure.

The presence of $Ni_5Zr$ precipitates in the Zr modified alloy clearly increases the elevated temperature mechanical strength, as measured both by tensile and stress rupture tests. Evidence that the Zr modified alloy possesses strengthened grain boundaries are shown both through metallography and residual property testing. By way of example, metallography of the tensile specimen tested at 1000 K revealed that the Ni-30 Cu base alloy failed intergranularly while the Zr modified alloy failed by a ductile mechanism. Also, metallography of stress rupture tested specimens indicated that the Ni-30 Cu base alloy contains intergranular cracks for all test temperatures while intergranular cracks were only seen in the Zr modified alloys after testing at temperatures above or equal to about 1100 K.

Residual mechanical properties were determined by room temperature testing of alloy specimens which had been subjected to conditions which would induce creep. Results of residual property tests are shown in Table IV.

Table IV

Residual Room Temperature Tensile Properties of Exposed Ni-30 Cu Base Alloys

| Alloy | Prior Exposure | Offset 0.2 Yield $MN/m^2$ | Tensile Properties* UTS $MN/m^2$ | Elongation pct |
|---|---|---|---|---|
| Ni-30 Cu | None | 200 | 414 | 44 |
| Ni-30 Cu | 15 $MN/m^2$-1000K-361 h | 145 | 360 | 40 |
| Ni-30 Cu | 21 $MN/m^2$-1000K-171 h | 162 | 300 | 8 |
| Ni-30 Cu | 21 $MN/m^2$-1000K-362 h | 163 | 202 | 5 |
| Ni-30 Cu-Zr | None | 243** | 469** | 36* |
| Ni-30 Cu-Zr | 138 $MN/m^2$-800K-5-5 h | 278 | 503 | 30 |
| Ni-30 Cu-Zr | 138 $MN/m^2$-800K-505 h | 265 | 480 | 23 |
| Ni-30 Cu-Zr | 21 $MN/m^2$-1000K-362 h | 200 | 426 | 33 |
| Ni-30 Cu-Zr | 35 $MN/m^2$-1000K-501 h | 164 | 365 | 35 |
| Ni-30 Cu-Zr | 35 $MN/m^2$-1000K-501 h | 168 | 379 | 36 |

*Strength properties based on original cross sectional area.
**Average properties.

The Zr-modified alloy exhibited superior residual tensile properties when compared to the Ni-30 Cr alloy. Microstructural examination of the tested specimens revealed both surface and internal grain boundary cracks in all Ni-30 Cu specimens while only surface grain boundary cracks were seen in the Ni-30 Cu-Zr specimens. In addition, the tensile fracture regions of the Ni-30 Cu-Zr specimens appeared to be ductile while the fracture regions of the Ni-30 Cu specimens tended to be brittle in appearance.

X-ray analysis of the surface oxides formed during stress rupture testing of the base alloy and Zr modified alloy at 800 K and 1100 K indicated the presence of both CuO and NiO. The presence or absence of $Cu_2O$ could not be confirmed. Zirconium oxides were not detected in the oxide scale formed on the Zr modified alloy. In general, the oxide scales formed on the base alloy and Zr modified were identical.

While the preferred embodiment of the invention has been described, it will be appreciated that various modifications may be made without departing from the spirit of the invention or the scope of the subjoined claims. By way of example, while increasing or decreasing the amount of zirconium in the base nickel-copper alloy will affect the size, number and distribution of the precipitates, all Ni-Cu alloys containing $Ni_5Zr$-type precipitates will be strengthened in accordance with the invention. It is further contemplated that different solutionizing temperatures, different amounts of cold work prior to precipitation heat treatments, and different precipitation heat treatments may be utilized to produce an alloy containing $Ni_5Zr$ precipitates as the strengthening agent.

What is claimed is:

1. A nickel-copper alloy precipitation-strengthened by a dispersion of $Ni_5Zr$ precipitates produced by the thermomechanical processing of the alloy during solution treating and annealing for improved tensile strength to 1200° K and improved stress-rupture properties to 1100° K without effecting the oxidation characteristics of the alloy consisting essentially of
   about 30 weight percent copper,
   about 0.2 weight percent zirconium, and
   the balance nickel.

2. A method of improving the mechanical strength of nickel-copper alloys containing about 30 weight percent copper at elevated temperatures without affecting the oxidation characteristics comprising the steps of adding about 0.2 weight percent zirconium to said alloys to modify the same, casting the modified alloys into ingots, hot rolling said ingots into sheets at about 1450 K, warm rolling said sheets at about 920 K, and thermomechanically processing said modified alloy to produce a dispersion of $Ni_5Zr$ precipitates, said thermomechanical processing comprising the steps of solution treating said sheets for ½ hour at 1365 K in hydrogen, and annealing said sheets for ½ hour to 3 hours at a temperatue between 1025 K and 1225 K in hydrogen.

3. A method of improving the mechanical strength of alloys as claimed in claim 2 wherein the thermomechanical process includes the step of cold working the sheets prior to final annealing.

4. A method of improving the mechanical strength of alloys as claimed in claim 3 wherein the thermomechanical process includes about 10% cold working by ambient temperature rolling.

5. A method of improving the mechanical strength of alloys as claimed in claim 4 including a final annealing of said sheets for ½ hour at 1125 K in hydrogen.

* * * * *